US005383505A

United States Patent [19]

Cordasco, Jr.

[11] Patent Number: 5,383,505

[45] Date of Patent: * Jan. 24, 1995

[54] GOLF BAG COVER HAVING A REMOVABLE TOP

[76] Inventor: Louis M. Cordasco, Jr., 8 Wyman St. North, Rye Brook, N.Y. 10573

[ * ] Notice: The portion of the term of this patent subsequent to Jun. 22, 2010 has been disclaimed.

[21] Appl. No.: 55,735

[22] Filed: Apr. 30, 1993

Related U.S. Application Data

[63] Continuation-in-part of Ser. No. 743,168, Aug. 9, 1991, Pat. No. 5,220,950.

[51] Int. Cl.[6] ..... A63B 55/00

[52] U.S. Cl. ..... 150/159; 206/315.4

[58] Field of Search ..... 150/159, 160; 206/315.2, 315.3, 315.4

[56] References Cited

U.S. PATENT DOCUMENTS

| | | | |
|---|---|---|---|
| 1,899,825 | 2/1933 | Reach | 206/315.4 |
| 1,928,922 | 10/1933 | Adams | 206/315.4 |
| 2,094,186 | 9/1937 | Patrick | 206/315.4 |
| 2,256,521 | 9/1941 | Kirkpatrick et al. | 206/315.3 |
| 2,681,232 | 6/1954 | Womack | 150/159 X |
| 2,704,563 | 3/1955 | Henrich | 150/159 |
| 2,718,521 | 9/1955 | Barbato | 150/159 |
| 2,907,364 | 10/1959 | Trenery | 150/159 |
| 2,985,212 | 5/1961 | Dozier | 150/159 |
| 3,316,951 | 5/1967 | Jacobson | 206/315.4 X |
| 3,521,689 | 7/1970 | Woods, Jr. | 150/159 X |
| 3,901,299 | 8/1975 | Picco | 206/315.3 |
| 4,143,694 | 3/1979 | Gregory | 206/315.3 |
| 4,498,579 | 2/1985 | Brick | 206/315.4 |
| 4,512,465 | 4/1985 | Jobe | 206/315.4 |
| 4,657,135 | 4/1987 | Kjose | 206/315.4 X |
| 4,953,768 | 9/1990 | Muse | 150/159 X |
| 4,961,497 | 10/1990 | Sherer et al. | 206/315.4 |
| 5,005,623 | 4/1991 | Webster, Jr. | 150/159 |
| 5,058,642 | 10/1991 | Tuntland | 150/159 |
| 5,131,442 | 7/1992 | Bevier | 206/315.4 X |
| 5,220,950 | 6/1993 | Cordasco | 150/159 |

FOREIGN PATENT DOCUMENTS

| | | | |
|---|---|---|---|
| 437122 | 10/1935 | United Kingdom | 206/315.3 |

*Primary Examiner*—Sue A. Weaver

*Attorney, Agent, or Firm*—Lackenbach Siegel Marzullo Aronson & Greenspan

[57] ABSTRACT

A protective cover with a removable top portion protects and covers a golf bag. The protective cover includes a base portion and a middle portion which is connected to the base portion, and has an opening for allowing the golf bag to be inserted into the cover with the base of the golf bag fitting into the base portion of the cover. Further, the cover includes a top portion removably attached to the middle portion which can be used as an accessory bag when not in use to cover the golf clubs. The top portion has a height sufficient for covering a plurality of golf clubs stored in the golf bag, and an opening is also provided in the top portion for allowing access to the golf clubs.

39 Claims, 12 Drawing Sheets

GOLF BAG COVER HAVING A REMOVABLE TOP

CROSS REFERENCE TO RELATED APPLICATIONS

This application is a continuation-in-part of U.S. patent application Ser. No. 07/743,168 filed Aug. 9, 1991, (now U.S. Pat. No. 5,220,950, granted Jun. 22, 1992.

BACKGROUND OF THE INVENTION

1. Field of the Invention

The present invention relates generally to golf bag covers and, more particularly, to a golf bag cover equipped with a removable top which protects the entire golf bag and the golf clubs stored therein.

2. Description of the Related Art

Covers which are designed to enclose and protect a golf bag and golf clubs while traveling are conventionally known. Examples of such golf bag travel covers are disclosed in U.S. Pat. Nos. 3,316,951; 4,512,465; and 4,657,135. Such travel covers are required to be constructed of durable and rugged material to withstand the rigors and rough handling associated with traveling. Accordingly, golf bag travel covers are made of a heavy canvas or similar material, or even impact resistant, high density molded polyurethane. Generally, such travel covers are bulky and do not allow convenient accessibility to the golf clubs contained therein. Therefore, golf bag travel covers are not optimally designed or constructed to be used while actually golfing so as to protect the golf bag and golf clubs from the effects of the golf course and the weather.

Attempts have been made to provide protection for golf bags and/or golf clubs while golfing. For example, U.S. Pat. No. 2,985,212 to Dozier relates to a transparent waterproof golf bag cover which provides access to the golf clubs stored therein through a slit at its upper end. However, the bottom of the Dozier cover is open so that the cover can be pulled down over the golf clubs and golf bag. Such an opening at the bottom of the cover defeats the purpose of providing protection for a golf bag while golfing, because the bottom of the golf bag will be exposed, and whenever the golfer stands his golf bag upright on the ground to play a shot, the unprotected bottom of his golf bag will be vulnerable to the ground upon which it is placed.

Moreover, disadvantageously, the opening at the bottom of the Dozier cover will allow the cover to "run up" or slide up along the length of the golf bag, leaving the golf bag at least partially uncovered and unprotected. The Dozier cover attempts to alleviate such a problem by providing a zipper at the bottom of the cover, so that when the zipper is closed, the bottom opening is reduced to provide a tighter fit. However, since the opening at the bottom of the cover is never completely closed, the bottom of the golf bag will never be completely protected and the problem of the cover sliding up along the length of the golf bag will not be solved. A similar problem exists with rain covers as disclosed in U.S. Pat. No. 4,853,768 to Muse since the bottom of the golf bag remains exposed. Other examples of golf bag rain covers are disclosed in U.S. Pat. Nos. 2,681,232; 2,718,251; and 2,907,364.

U.S. Pat. No. 5,005,623 to Webster, Jr. relates to another golf bag rain cover which only encloses the top of the golf bag and golf clubs. In other words, the middle and bottom portions of a golf bag are not protected by the Webster, Jr. cover. Similarly, U.S. Pat. Nos. 2,704,563 and 1,899,825 disclose covers only for the top portion of conventional golf bags to preclude rain entry into the bags. None of these covers effectively covers and protects the entire bag and clubs while permitting the flexible handling of clubs through the top portion of the cover during rain and also permitting the partial or complete removal of the top portion of the cover, preferably during good weather.

Thus, there remains a need for a cover which snugly and securely encases a golf bag, allows for easy insertion of the golf bag and golf clubs into the cover, can be conveniently used while golfing, protects the entire golf bag as well as the golf clubs stored therein, and allows for easy access to golf clubs stored in the golf bag, as well as other items stored in the golf bag, such as tees, balls, shoes, raingear, sweater, a telephone, etc.

SUMMARY OF THE INVENTION

It is, therefore, a principle object of the present invention to provide an improved golf bag and golf club cover which overcomes all of the disadvantages of prior covers.

Generally, the golf bag and golf club cover of the present invention includes a base portion, a middle portion and a top portion. The middle portion is connected to the base portion and has a first middle portion opening allowing a golf bag with a neck and base to be inserted therein, whereupon the base of the golf bag fits into the base portion. The top portion is removably connected to the middle portion, has a height sufficient for covering golf clubs within the golf bag, and includes an opening which allows for easy access to the golf clubs. Furthermore, securing means may be provided to secure the cover to the golf bag. In several alternative preferred embodiments the top portion is also both completely and partially removable. when at least partially removed, the top portion may be used as a separate closable accessory bag. Accordingly, the cover of the present invention fits snugly and securely on to the golf bag, can be conveniently used while golfing, protects the entire golf bag as well as the golf clubs contained therein, and allows for easy, versatile access to the golf clubs and accessories.

Other objects, features and advantages of the present invention will become apparent with the following detailed description taken together with the accompanying drawings.

BRIEF DESCRIPTION OF THE DRAWINGS

For a fuller understanding of the invention, reference is made to the following description taken in connection with the accompanying drawings in which.

DETAILED DESCRIPTION OF THE PREFERRED EMBODIMENTS

Figure 1:
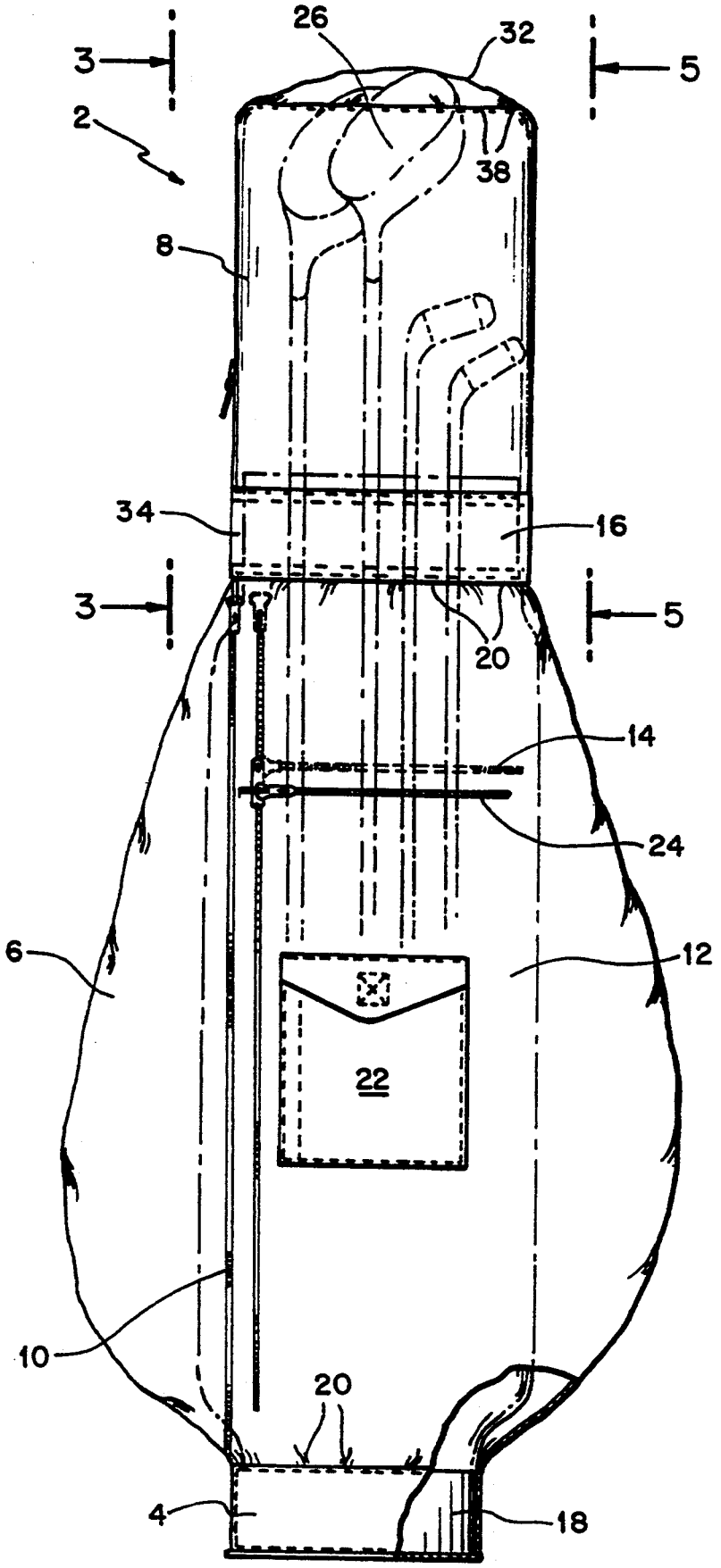
FIG. 1 is a front view of the golf bag cover according to the present invention.

Referring to the Figures, a protective cover 2 for a golf bag 12 and golf clubs 26 according to the present invention includes a plurality of portions. For example, a base portion 4, a middle portion 6, and a top portion 8. The middle portion 6 may include a first middle portion opening 10 which is positioned, for example, in the front of the middle portion 6 and illustratively extends along the full middle portion 6 for allowing a golf bag 12 to be inserted into the cover 2, and/or allowing access to a storage pocket 14 which may be provided along a side of the golf bag 12. In this connection, golf bags generally have storage sections, such as one or more means, such as storage pocket 14 for storing golf club head covers, golf balls, gloves, tees, golf shoes, a rain jacket, etc.; and such storage pockets 13 and 14 may be, for example, zippered openings which extend along the length of the golf bag or horizontally across a side of the golf bag.

In one embodiment of the cover, a zippered opening 24 may be included in the cover 2 and positioned, for example, at a suitable angle, such as a right angle relative to the first middle portion opening 10. Preferably, the zippered opening 24 is aligned so as to correspond to the location of the storage pocket 14 in the golf bag 12 so as to allow quick and easy access to the contents of the storage pocket 14.

The cover 2 is sufficiently flexible to be folded compactly and stored away in one of the storage pockets of the golf bag until the golf bag 12 and/or golf clubs 26 need to be protected, such as when a golfer encounters rain or other inclement weather while golfing.

The base portion 4 has a diameter and size which allows the base 18 of the golf bag 12 to fit substantially snugly within the base portion 4. Further, the first middle portion opening 10 may include a zipper or other suitable means to close the first middle portion opening 10 so that the golf bag 12 will be entirely encased within and protected by the golf bag cover 2.

Preferably, the middle portion 6 is oversized and somewhat "baggy" relative to the golf bag 12, and may include a plurality of gatherings or pleats 20. The oversized middle portion 6 along with the pleats 20 allow the middle portion 6 to expand when required for storing golfing supplies in, for example, the storage pockets 13, 14 along the side of the golf bag. In this regard, optionally, the middle portion 6 may include a storage pocket 22 for storing items, such as score cards.

The top portion 8 is connected to the middle portion 6 and preferably has a height sufficient for completely covering golf clubs 26 stored in the golf bag 12. The top portion 8 includes at least one opening which allows for (access) success to the golf clubs 26 stored in the golf bag 12. For example, a first top portion opening 28 can be positioned along a side of the top portion 8 and/or a second top portion opening 30 can extend across the uppermost area 32 of the top portion 8. The second top portion opening 30 allows for access to longer golf clubs (such as woods) because such longer clubs can be removed from the uppermost area 32 of the cover 2; and allows a golfer to view his entire selection of golf clubs 26 stored in the golf bag 12, since the second top portion opening 30 allows the top portion 8 to be open across the uppermost area 32. Such first and second top portion openings 28, 30 preferably include suitable closure means, such as zippers, hook and loop fasteners, snaps, etc. As shown in the Figures, the first and second top portion openings 28, 30 may be substantial right angles or transverse relative to one another.

Moreover, suitable wrapping/locking means, such as securing band 34 is preferably provided as part of the cover 2. For example, the securing band 34 may be connected to or integral with part of the top portion 8 and positioned around the top portion or neck 16 of the golf bag 12 so that the cover 2 is secured snugly in place around the neck 16 of the golf bag 12 so as to position and maintain the cover in place about the golf bag 12, in conjunction with the base of the cover as noted herein. If desired, the ends may be fastened together or overlapped and fastened by a fastener 36 which, for example, snugly secures the band 34 around the golf bag 12. Such a fastener 36 can be, for instance, a loop and hook fastener, a snap, a button and buttonhole, etc. Thus, the cover 2 will remain in position relative to the golf bag 12.

A plurality of pleats 38 may be provided around the uppermost area 32 of the top portion 8. The pleats 38 will allow the top portion 8 to expand so as to accommodate a multitude of golf clubs.

Additionally, a slit or second middle portion opening 40 may be provided, for example, along the rear of the middle portion 6. The second middle portion opening 40 allows for the protrusion of a shoulder strap 42 and/or handle 44 of the golf bag 12 contained within the cover 2. In this connection, the strap 42 is generally attached to the top of the golf bag 12, so that it will protrude through the first top portion opening 28 above the band 34.

Figure 2:
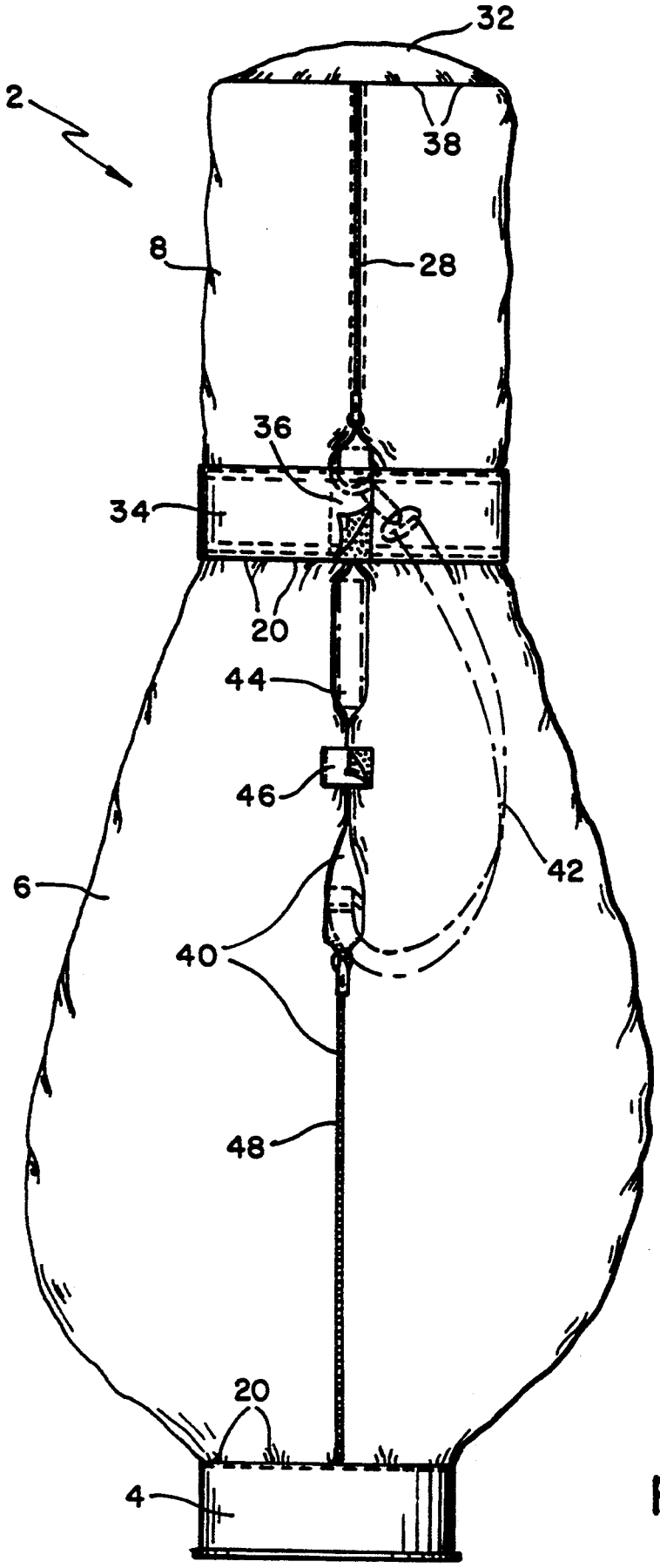
FIG. 2 is a rear view of the golf bag cover according to the present invention.
Figure 3:
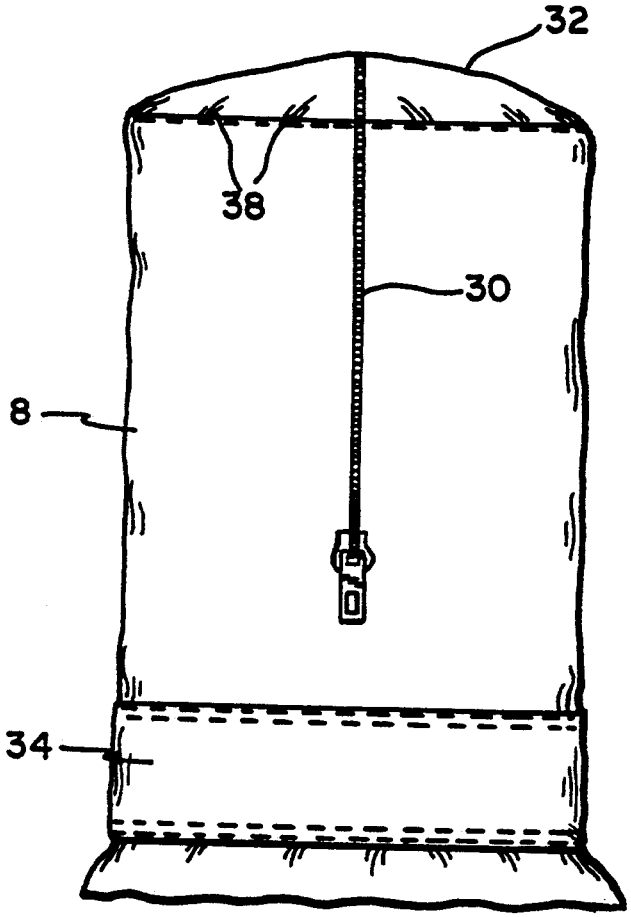
FIG. 3 is a view taken along the arrows 3—3 of FIG. 1.
Figure 4:
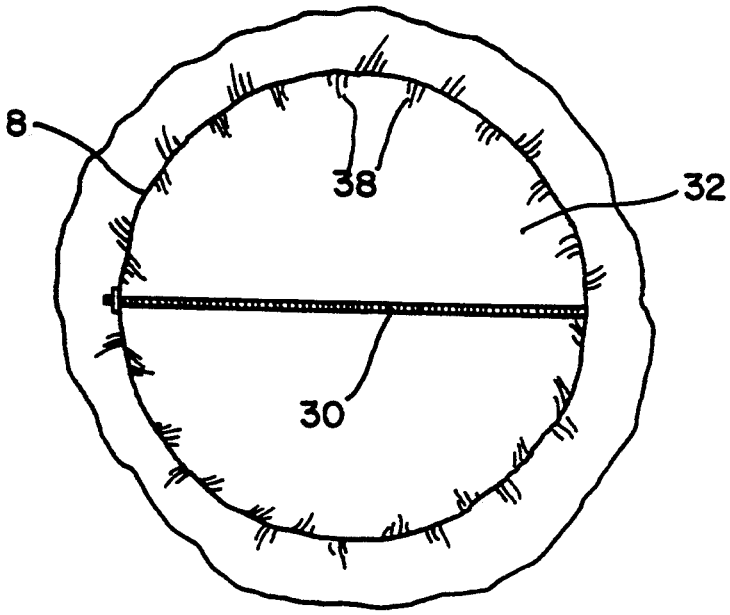
FIG. 4 is a top view of the golf bag cover according to the present invention.
Figure 5:
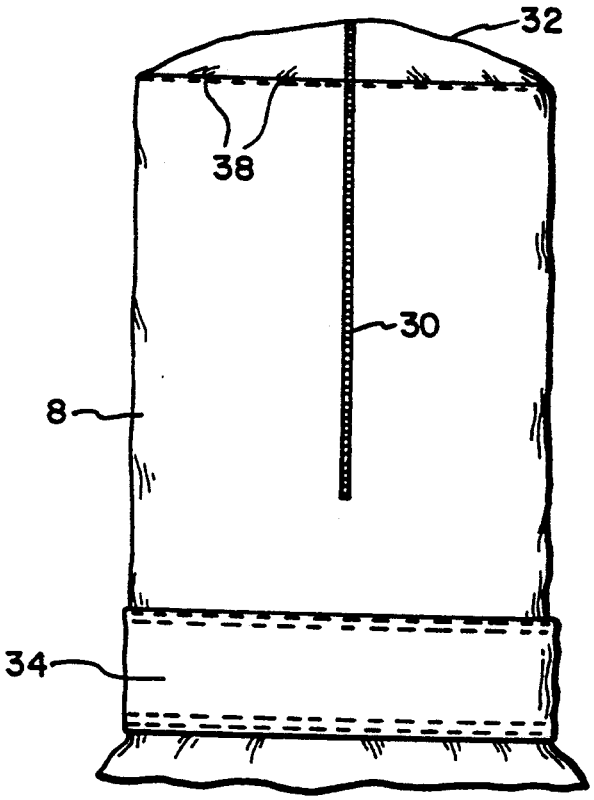
FIG. 5 is a view taken along the arrows 5—5 of FIG. 1.
Figure 6:
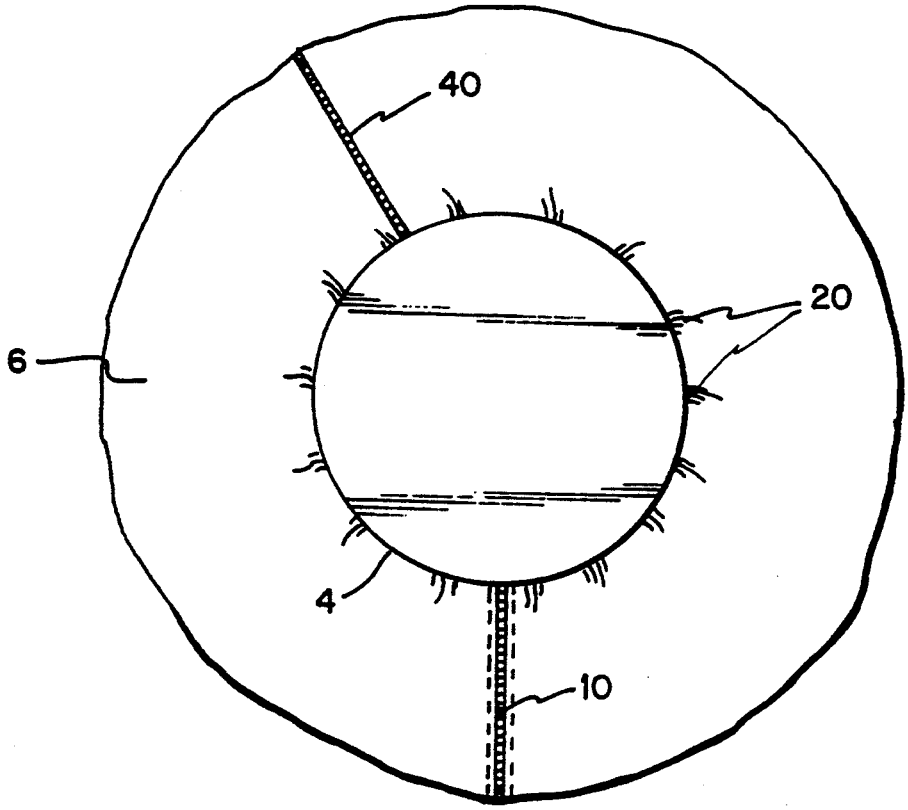
FIG. 6 is a bottom view of the golf bag cover according to the present invention.

Moreover, the second middle portion opening 40 extends along the entire length of the middle portion 6, and includes lower fastener means, such as zipper 48 and preferably one or more closure means, such as loop and hook fastener 46 for pulling together and/or closing at least a section of the second middle portion opening 40. Preferably, for simplifying insertion of the golf bag 12 and golf clubs 26 into the cover 2, the second middle portion opening 40 may be aligned with the first top portion opening 28. Thus, when both openings 28 and 40 are open or unclosed, they will conjunctively in effect form and (best shown in FIG. 2) constitute a single opening extending from the top portion 8. It should also be understood that in the embodiment which includes the securing band 34, the opening provided between the unfastened ends of the securing band 34 can also be aligned with the first top portion opening 28 and second middle portion opening 40 to provide a single opening extending from the base portion 4 to the uppermost area 32 of the top portion 8.

Such a single opening advantageously allows the golf bag 12 having the golf clubs 26 stored therein to be inserted into the cover 2, without the need for prior removal of the golf clubs 26 from the bag 12 before inserting the golf bag 12 and the golf clubs 26 into the cover 2. Such a feature is advantageous and desirable in that the golf bag 12 and the golf clubs 26 can be quickly, conveniently and easily inserted into the cover 2. Frequently, golfers encounter inclement weather, such as rainstorms, while golfing and require immediate protection for their golf bag and golf clubs. The feature of the single opening extending from the base portion 4 to the uppermost area 32 allowing for the golf bag 12 with the golf clubs 26 stored therein to be inserted into the cover 2, without removal of the golf clubs 26 from the golf bag 12, is desirable in such situations and thus most advantageous where sudden showers, hall or the like may occur.

In a further embodiment of the invention, the second middle portion opening 40 may not be aligned with the opening between the end of the band 34 or with the second top portion opening 30. Indeed, the second top portion opening 30 is also not a required feature of the invention, since the golf clubs 26 can be removed from or inserted into the bag 12 through the first top portion opening 28. In this regard, the golf bag 12 with the golf clubs 26 removed therefrom can be inserted into the cover 2 through either the first or second middle portion opening 10, 40, and the golf clubs 26 can then be inserted into the golf bag 12 through the first top portion opening 28. However, it should also be understood that the cover 2 may include only the second top portion opening 30 without the first top portion opening 28. In such an alternative embodiment, the golf bag 12 and golf clubs 26 would likewise be inserted into the cover 2 separately, i.e., the golf clubs 26 would be inserted through the first top portion opening 32 after the golf bag 12 was inserted through a middle portion opening 10 or 40.

In another embodiment, the second top portion opening 30 is excluded from the top portion 8. In such an embodiment, the cover 2 is assembled about the golf bag 12 with the golf clubs 26 stored therein by first encasing the golf clubs 26 within the top portion 8, and pulling the middle portion 6 down along the length of the bag 12 so that the base portion 4 can be fitted about the base of the golf bag 12 while the second middle portion opening 40 is unclosed. The second middle portion opening 40 can then be closed, and the golf clubs 26 can then be accessed through the first top portion opening 28.

Preferably, the entire cover 2 is made of a substantially water repellant and/or waterproof material 104, so that the golf bag 12 and the golf clubs 26 stored therein will be protected when golfing during rainstorms. For example, the cover 2 can be constructed of a plastic or other synthetic material or even a natural or synthetic rubber, "Goretex", etc.; or the cover 2 can be constructed of a non-waterproof material which is rendered waterproof by a suitable coating or lining, such as by using conventional "waterproofing" substances, such as "Scotchguard", waxes, etc. However, it is preferable that the material used is strong yet adequately collapsible and flexible, i.e. "soft", so that the cover 2 can be compactly folded or rolled, for example, in a "ball" for storing, such as in a storage pocket of the golf bag 12. The cover 2 may also be of a solid color or various contrasting colors for identification and eye pleasing purposes; and, if desired, the top portion 8 can be of a substantially clear or transparent material for allowing convenient viewing of the various golf clubs through the cover 2. Such material may also be selected from the group consisting of synthetic and natural rubbers, polyethylene-cotton, polyolefin-cotton, nylon, dacron, rayon, polyamides, laminated fabrics, layered fabrics, GORTEX, sailcloth, and combinations thereof.

Figure 7:
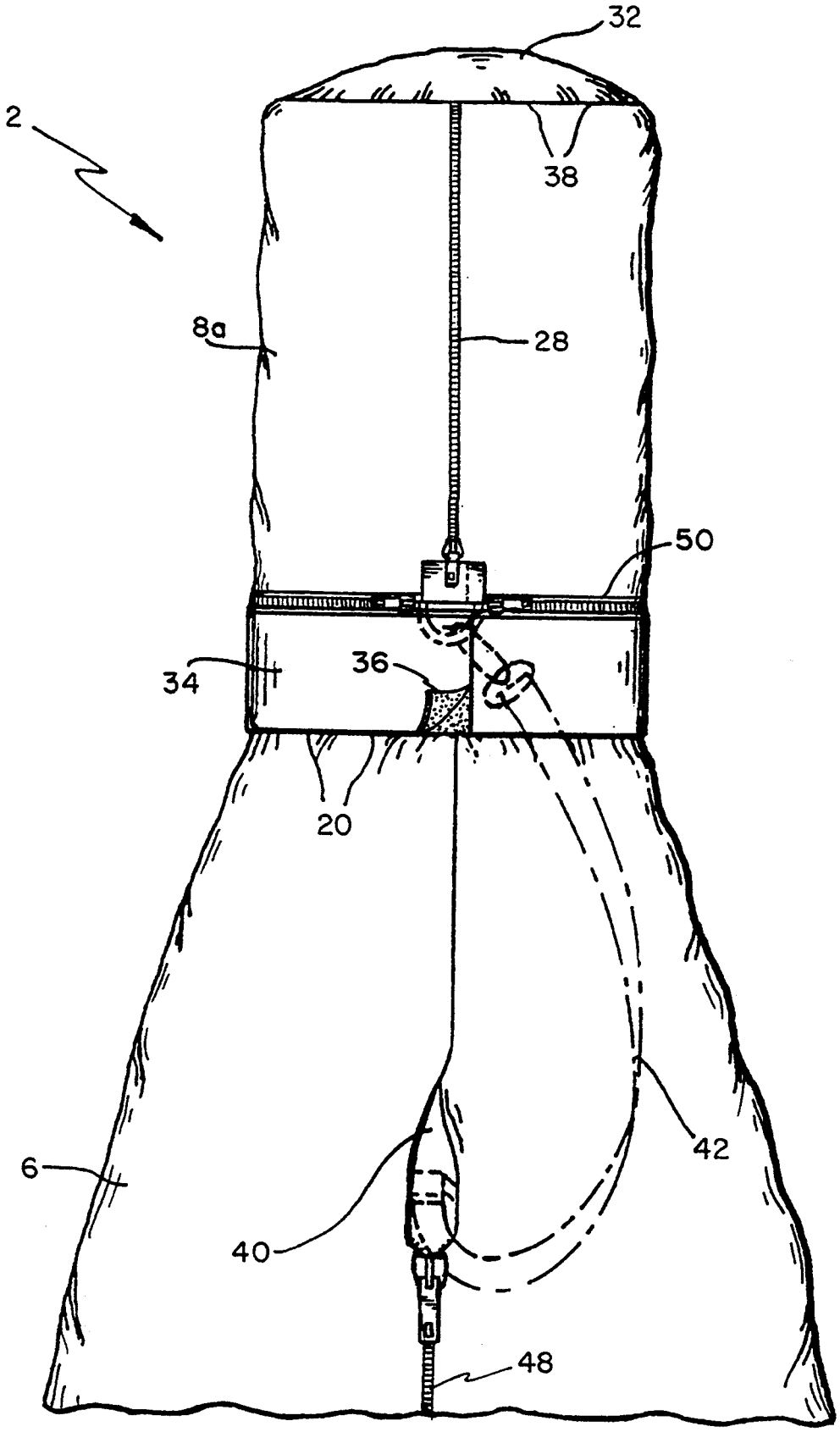
FIG. 7 is a partial rear view of the upper portion of a first alternative embodiment of the golf bag cover in accordance with the invention.
Figure 13:
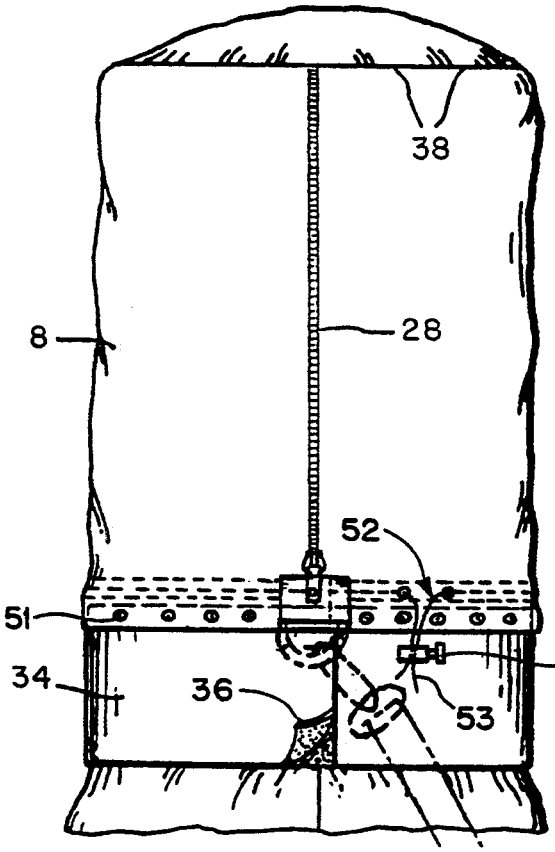
FIG. 13 is a second alternative embodiment of the golf bag cover in accordance with the present invention.
Figure 14:
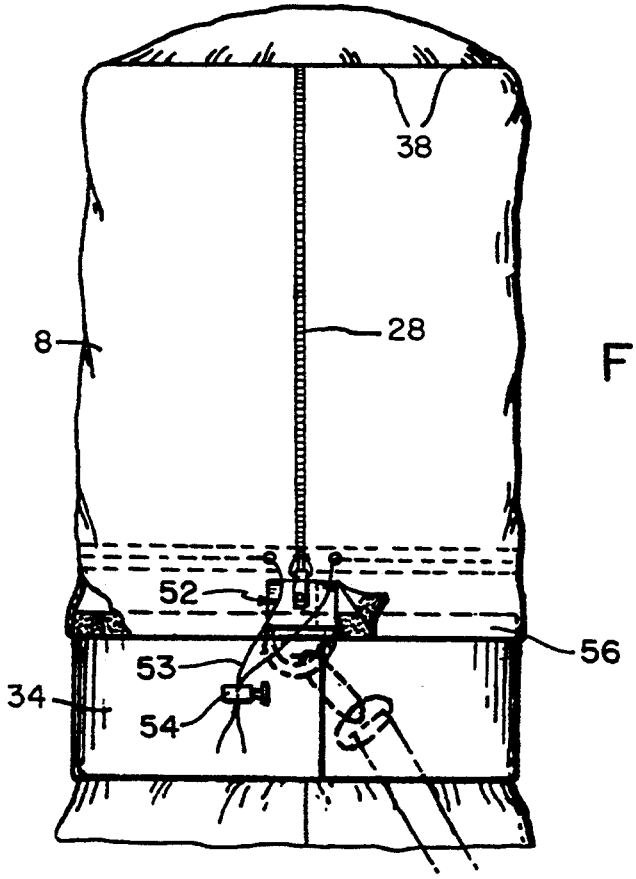
FIG. 14 is a third alternative embodiment of the golf bag cover in accordance with the present invention.

A first alternative preferred embodiment of the golf bag cover in accordance with the present invention, is shown in FIGS. 7 through 12 and 15 and 16. Second and third alternative preferred embodiments are shown in FIGS. 13 and 14 respectively. Note that like numbers are used to describe like components throughout this description. The first alternative preferred embodiment is a golf bag cover 2 with a removable top portion 8*a* almost identical to the top portion 8 described above with reference to FIGS. 1 through 6. However, in this embodiment, the top portion 8*a* is fastened to the securing band 34 by a zipper 50. The zipper 50 may have a single or double pull slider arrangement. Preferably the zipper 50 is a two way zipper, as shown in FIG. 7, with a pair of opposing pull sliders which meet upon closing at the base of the opening 28 where the shoulder strap 42 of the golf bag 12 protrudes.

Figure 8:
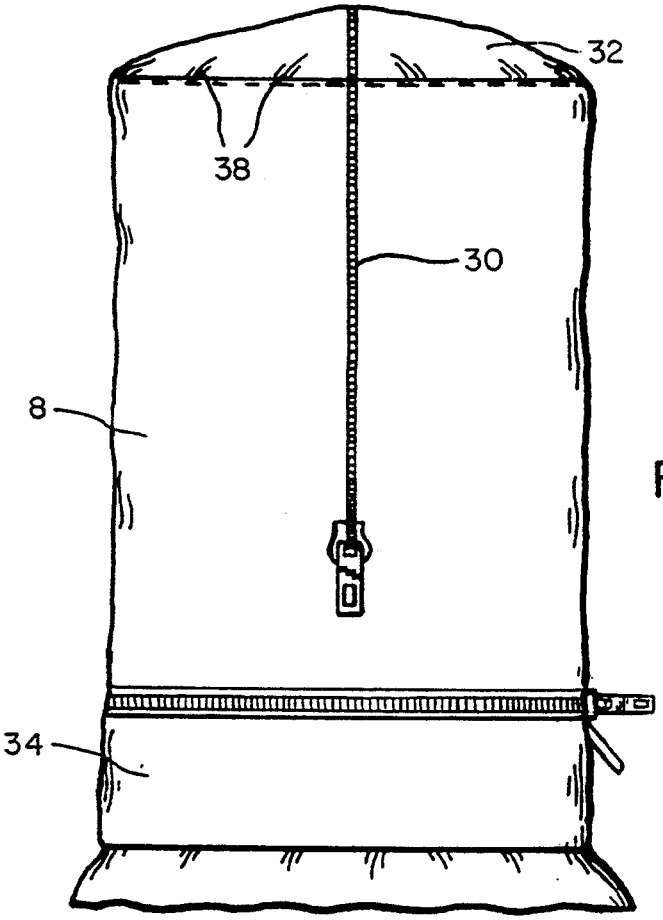
FIG. 8 is a partial side view of the alternative embodiment shown in FIG. 7, rotated approximately 90 degrees counterclockwise.
Figure 9:
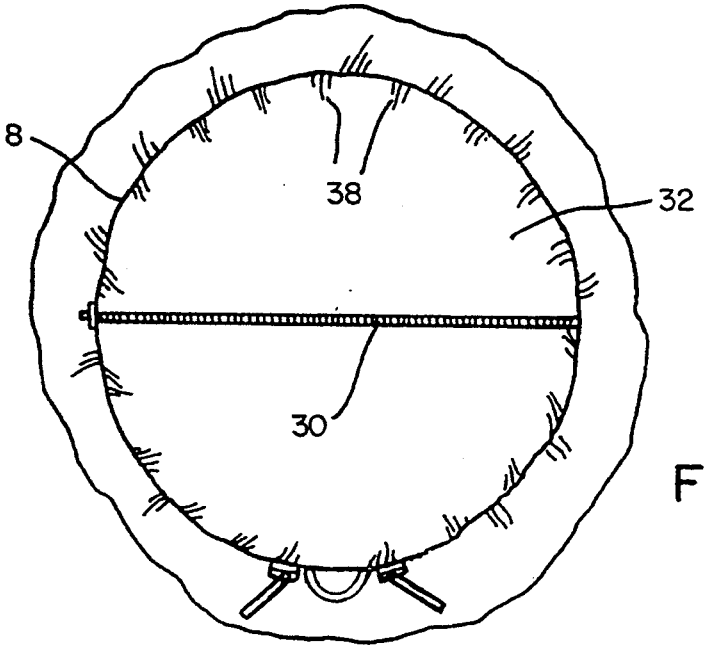
FIG. 9 is a top view of the alternative embodiment shown in FIG. 7.
Figure 10:
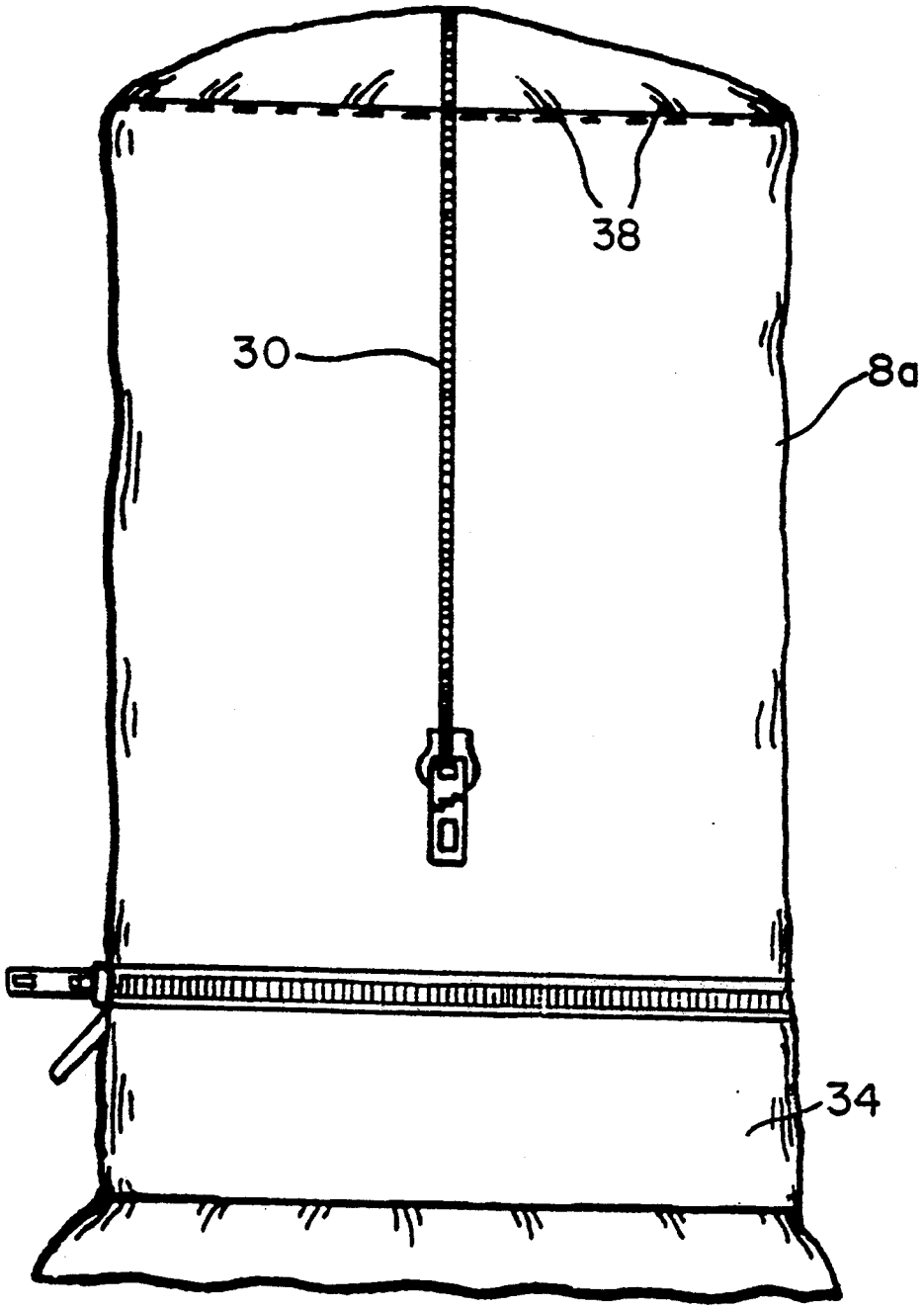
FIG. 10 is partial side view of the alternative embodiment shown in FIG. 7, rotated approximately 90 degrees clockwise.

FIGS. 8 through 10 are side and top views of the top portion 8*a* which show that the first and second top openings 28 and 30 are the same as in the first embodiment described with reference to FIGS. 1 through 6. One side of the zipper 50 is sewn to the upper edge of the securing band 34. The other side of the zipper 50 is matchingly sewn to the bottom edge of the top portion 8*a* so that the single zipper slider or pair of sliders meet, when the zipper is fully closed, at the fastener 36 adjacent to the shoulder strap engaging ring.

Figure 11:
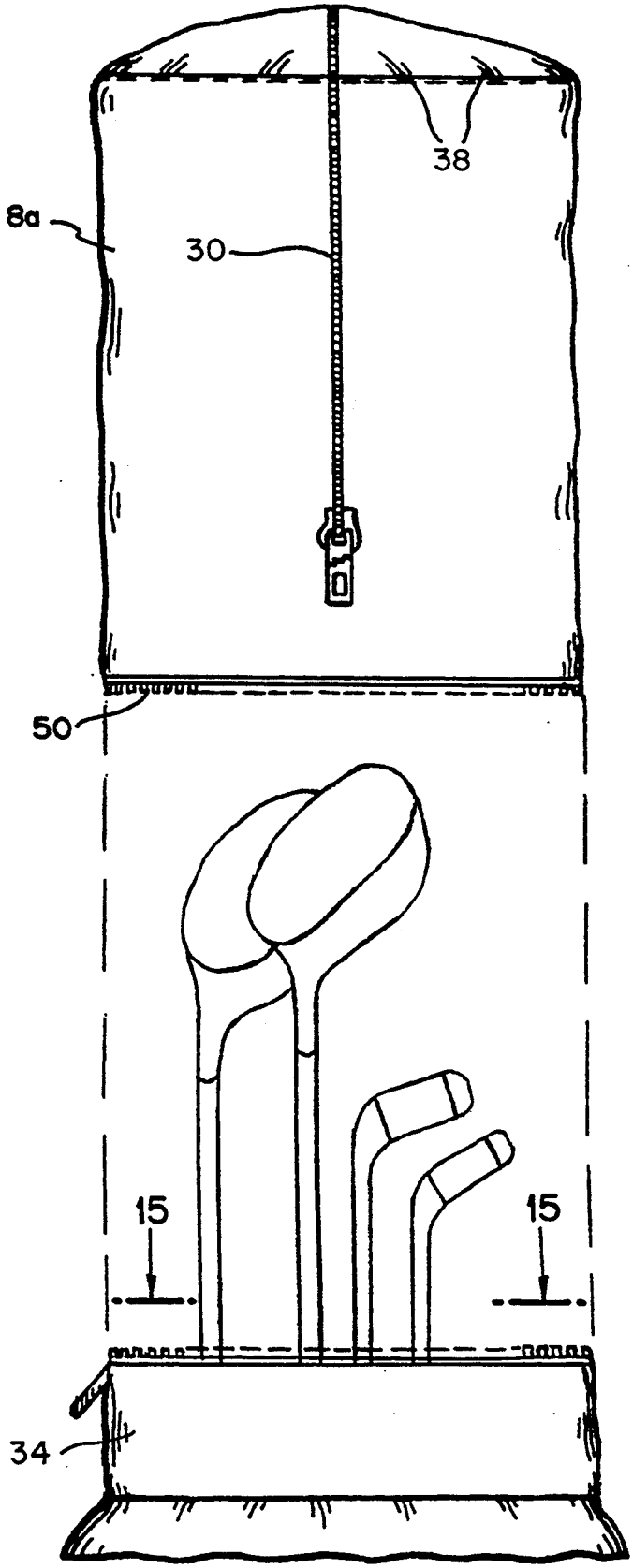
FIG. 11 is an exploded view of the alternative embodiment shown in FIG. 7.

The top portion 8*a* may be fully closed, as previously described, over the top of the golf bag 12 as is shown in FIGS. 7 through 10 during inclement weather. When the rain passes and the weather clears, as is often the case, the top portion 8*a* may be opened by unzipping second top portion opening 30 and peeling back the halves of the top portion so formed like opening a clam shell. The two halves may be draped over the sides of the securing band 34. The top portion 8*a* may also be completely removed as is shown in FIG. 11 and stored. In addition, the top portion 8*a* may be only partially unzipped, and pulled off to one side so as to hang down over the securing band 34 as is shown in FIG. 12*a*. Partial removal of the top portion 8*a* has an added specific advantage in that the top portion material enables an integral hinge 100 to be formed thereby when folded over or down so as to produce a very handy bag or open pocket 102 for holding balls, a towel, camera, golf balls, hat, or other accessory.

As is shown in FIGS. 8 through 10, the zipper closed second top portion opening 30 is spaced from the circumferential zipper 50. The position of the second top portion opening 30 is also preferably rotated 90 degrees from that of the first top portion opening 28. The bottom edge of the securing band 34 is preferably sewn to the middle portion 6 with a plurality of gatherings or pleats 20 as is shown in FIG. 7. Alternatively, the bottom edge of the band 34 could also be fastened to the middle portion 6 via a zipper or a hook and loop fastener. A sewn connection is preferred, however, in conjunction with the hook and loop closure 36 for securing the band 34 to various sizes of golf bags.

Referring now to FIG. 13, a second alternative embodiment of the top portion **8*b* of the cover 2 in accordance with the invention is shown. The top portion 8*b* is removably attached to the upper edge of the securing band 34 with a plurality of spaced snaps 51. A closely spaced series is shown. However, it is to be understood that wider spacing with a smaller number of snaps may also be used. Again, the top portion 8*b* may be completely removed or partially removed to form the bag similar to that shown in FIG. 12. This embodiment includes another unique feature of the present invention. A drawstring assembly 52 is sewn into the lower end of the top portion 8*b* adjacent the snaps 51. This may be advantageously accomplished by simply folding the lower end and sewing a pair of spaced parallel stitches to form a passage for a drawstring 53. The ends of the drawstring 53 preferably exit the top portion through crimped grommmets to the exterior of the top portion 8*b* of the cover 2**.

Figure 12:
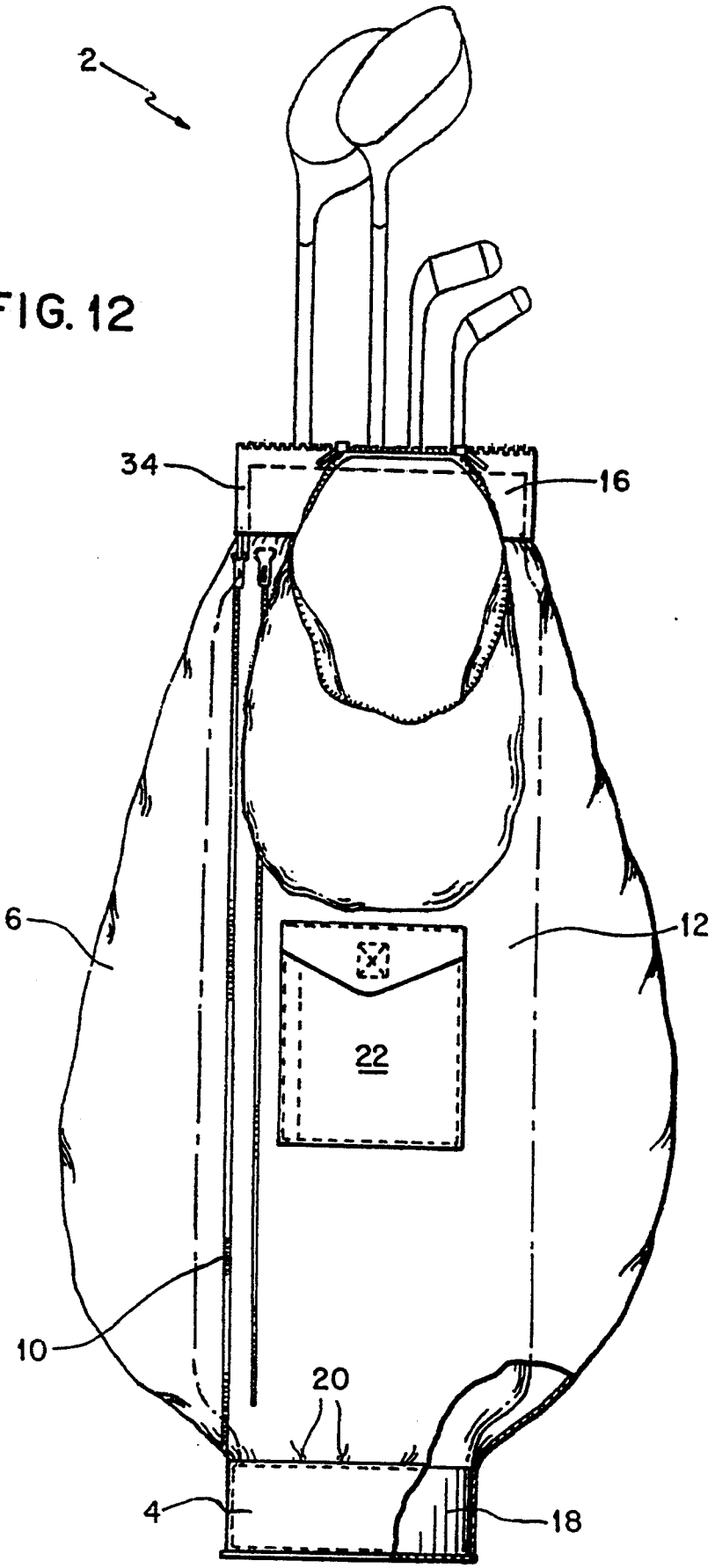
FIGS. 12 and 12*a* are front views of alternative embodiments of the golf bag cover shown in FIG. 7, with the top portion partially removed, forming an accessory bag in FIG. 12, and in FIG. 12*a* an integral accessory bag or attached hood.
Figure 12A:
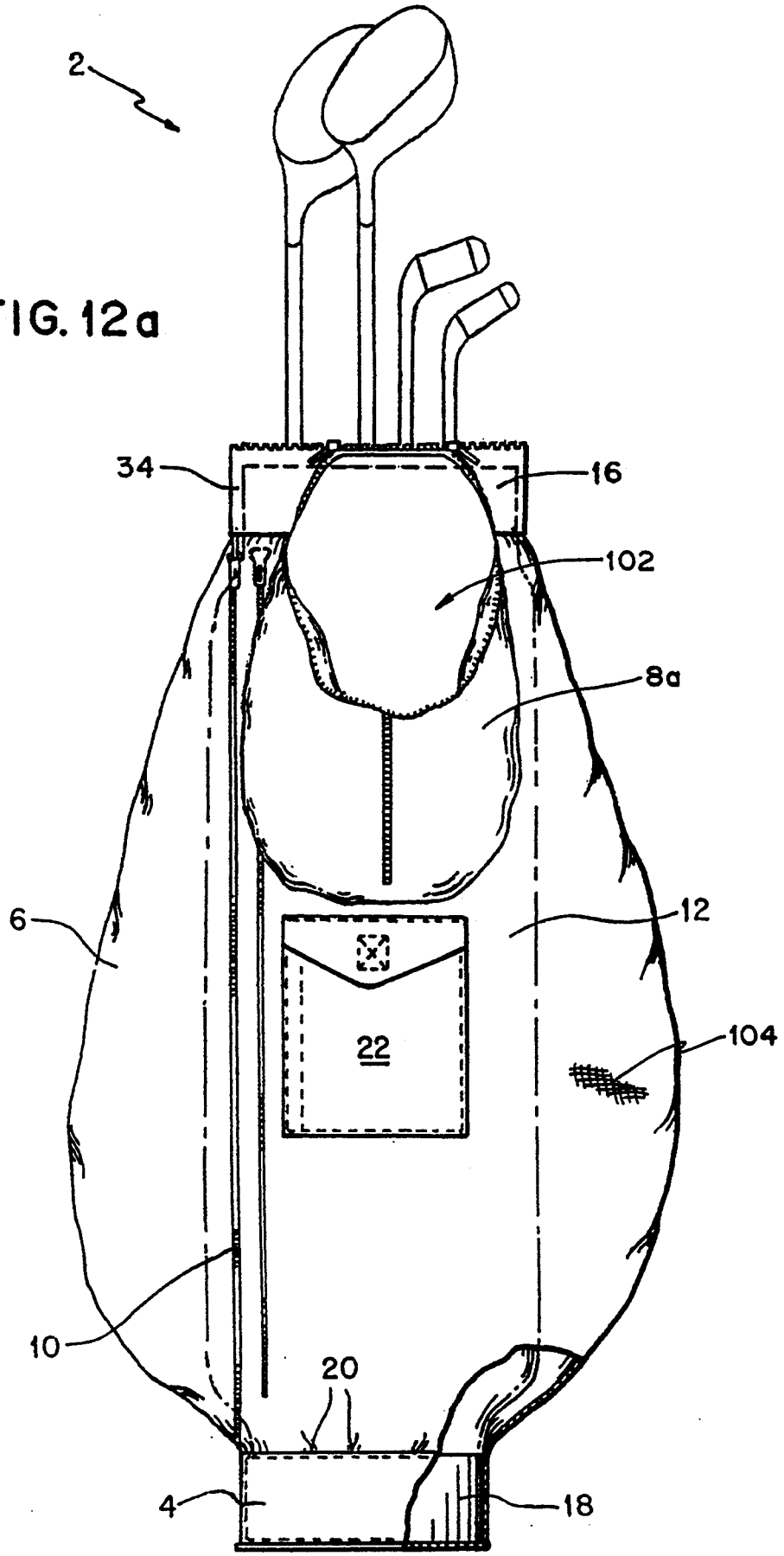

When the top portion **8*b* is partially removed as shown in FIG. 12, the drawstring assembly 52 may be used to at least partially close the opening into the bag formed by the top portion 8*b*. When the top portion 8*b* is completely removed, the drawstring assembly may be used to completely close the bag formed thereby and also secure the bag to a cart or other object. The drawstring assembly also preferably includes a slide lock 54 which holds the ends of the drawstring 53 at any desired position. The drawstring 53 may exit the top portion 8*b* at any position such as adjacent to the fastener 36 as shown in FIG. 13**.

A third alternative embodiment of the cover in accordance with the invention is shown in FIG. 14. Here, the top portion **8*c* is identical to the top portions 8*a* and 8*b* except that the attachment means joining the top portion 8*c* to the securing band 34 is a strip of hook and loop fastening material 56 sewn or otherwise bonded to the lower edge of the top portion 8*c* and the upper edge of the securing band 34. As in the second alternative embodiment just described, this third alternative embodiment includes a drawstring assembly 52 for the same purposes as above described. However, in FIG. 14, the drawstring assembly is positioned adjacent the lower end of the first top portion opening 28 and the drawstring exits the top portion on either side of the opening 28. This drawstring arrangement may also be used on either of the embodiments above described. The location of the grommets for exit of the drawstring 53 may be to either to the inside or to the outside of the top portion of the cover 2** or both. The latter may be preferable as the user can decide which is most convenient for his or her purposes.

Figure 15:
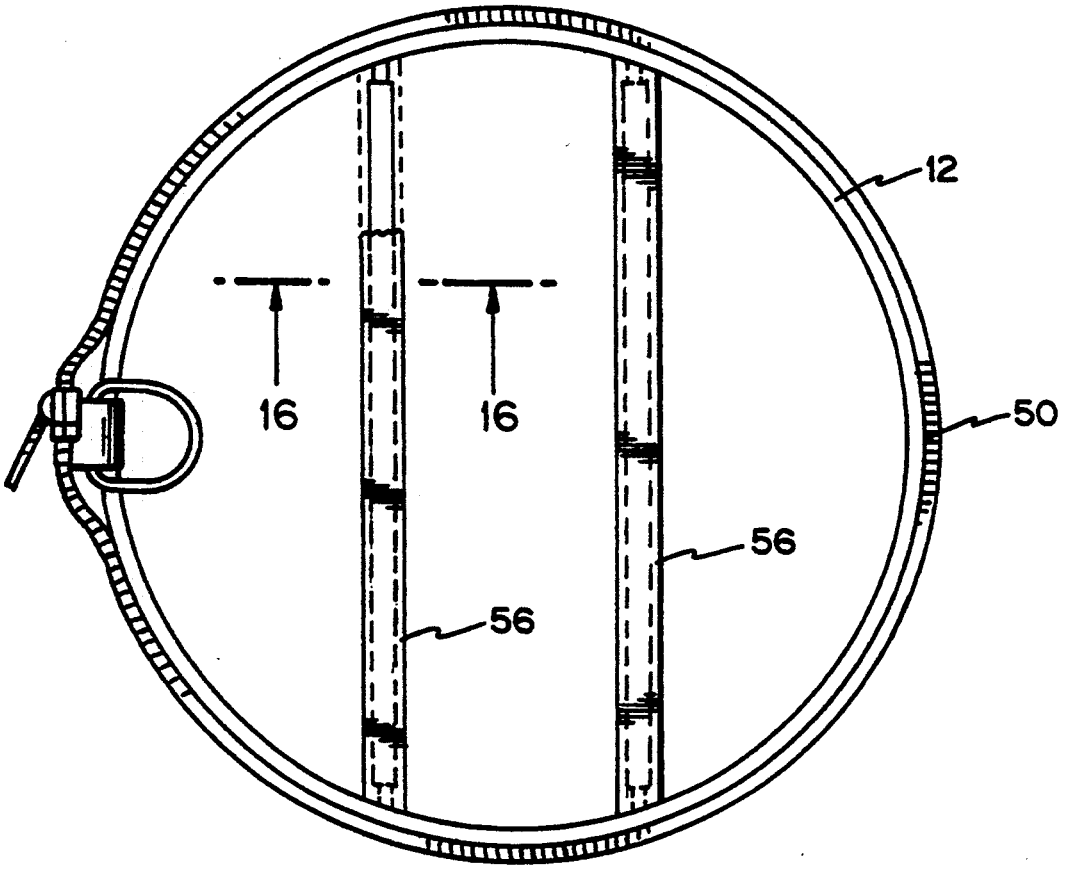
FIG. 15 is a top view of the golf bag and alternative golf bag cover in accordance with the invention taken along the line 15—15 in FIG. 11.
Figure 16:
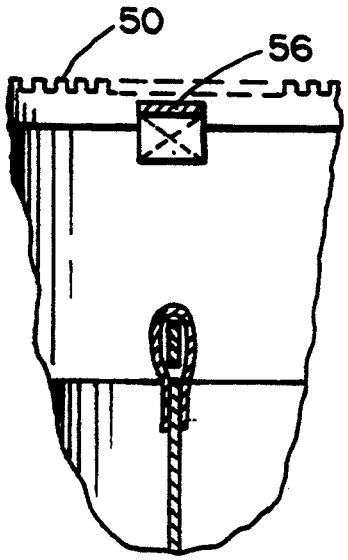
FIG. 16 is a partial sectional view of the golf bag and golf bag cover taken along the line 16—16 in FIG. 15.

Finally, a top view of the middle portion with the top portion removed is shown in FIG. 15. This view shows the position of a pair of straps 56 which are sewn to the inside of the securing band 34. These straps 56 are positioned and spaced parallel to each other so as to be superimposed over the separating bars in the golf bag 12 as shown in the partial sectional view of FIG. 16. these straps provide some protection to the dividers and help guide and ensure replacement of clubs into the correct compartment after use. It should be noted that the straps 56 and said protective cover 2 are all made of the same material.

While the invention is disclosed and more particularly described herein with reference to the preferable embodiments, it is not intended that the invention be limited to the described embodiments. It will be obvious to those skilled in the art that modifications may to be made without departing from the scope and spirit of the invention. For example, the features of each alternative embodiment described herein may be used in combinations other than as described. Accordingly, the drawstring assembly 52 shown in FIGS. 13 and 14 may be utilized with the zippered connection of the top portion **8*a* shown in FIGS. 7 through 12**. Thus, it is intended that the appended claims cover all equivalent variations as may be subsequently contemplated. All patents, patent applications and publications referenced herein are hereby incorporated herein-by reference in their entirety.

What is claimed is:

1. A pliable and foldable protective two piece cover for covering a golf bag having a base and being adapted to store a plurality of golf clubs comprising:

a base portion;

a middle portion connected to said base portion and forming one of said two piece protective cover, and having a first middle portion opening for allowing said golf bag to be inserted therein, with the base of said golf bag fitting into said base portion of said cover;

a top portion including means to at least partially removably connect it to an upper most edge of said middle portion, said top portion having sides and an uppermost area, and having a height sufficient for covering said plurality of golf clubs stored in said golf bag, and further having a first top portion opening for allowing access to said plurality of golf clubs; and said protective cover being fabricated from an impervious, flexible material, whereby said protective cover may be folded into a substantially small package for storage within said golf bag when not in use, whereby said protective cover may be retained on said golf bag even with the top portion partially removed or when completely removed may be collapsed and stored in said golf bag.

2. A pliable and foldable protective cover for covering an entire golf bag having a plurality of storage sections, a neck and a base and being adapted to store a plurality of golf clubs comprising:

a base portion of a diameter in size for said base of said golf bag to fit therein;

a baggy middle portion connected to said base portion for accommodating all storage sections of the golf bag, and having a first middle portion opening for allowing said golf bag to be inserted therein, with the base of said golf bag fitting into said base portion of said cover;

a top portion including means to at least partially removably connect to an uppermost edge of said middle portion, said top portion having sides, a bottom edge and an uppermost area, and having a height sufficient for covering said plurality of golf clubs stored in said golf bag, and further having first and second top portion openings, said first top portion opening for allowing access to said plurality of golf clubs, and second top portion opening positioned across the uppermost area of said top portion and extending along a side of said top portion, with said first and second top portion openings being transverse relative to one another; and means forming a part of said cover disposed between said middle and top portions for securing in conjunction with said base portion said cover snugly in place around said golf bag, so as to position and maintain said cover in place about said golf bag; whereby said protective cover may be retained on said golf bag even with the top portion partially removed or when completely removed may be collapsed and stored in said golf bag.

3. The cover according to claim 2 wherein said top portion connecting means includes said bottom edge of said top portion at least partially removably connected to said middle portion by a zipper having at least one slider, so that said zipper and top and middle portions form a continuous structure.

4. The cover according to claim 3 wherein said zipper has a pair of opposing sliders.

5. The cover according to claim 3 further comprising a drawstring closure assembly substantially along the bottom edge of said top portion.

6. The cover according to claim 2 wherein said top portion connecting means includes a series of cooperatively associated snap fasteners along the bottom edge of said top portion and said upper most edge of said middle portion.

7. The cover according to claim 6 further comprising a drawstring closure assembly substantially adjacent said series of snaps along the bottom edge of said top portion.

8. The cover according to claim 7 wherein said drawstring closure assembly includes a passage formed in said top portion adjacent said bottom edge, a drawstring in said passage, and at least one aperture through said top portion into said passage through which said drawstring passes.

9. The cover according to claim 8 wherein said assembly includes a pair of apertures into said passage through which said drawstring passes.

10. The cover according to claim 9 wherein said apertures straddle said first top portion opening.

11. The cover according to claim 2 wherein said top portion is connecting means includes a cooperatively associated hook and loop fastener along the bottom edge of said top portion and said upper most edge of said middle portion.

12. The cover according to claim 11 further comprising a drawstring closure assembly substantially adjacent said hook and loop fastener strip along the bottom edge of said top portion.

13. The cover according to claim 12 wherein said drawstring closure assembly includes a passage formed in said top portion adjacent said bottom edge, a drawstring in said passage, and at least one aperture through said top portion into said passage through which said drawstring passes.

14. A pliable and foldable protective cover for covering an entire golf bag having a plurality of storage sections, a neck and a base and being adapted to store a plurality of golf clubs comprising:

a base portion of a diameter and size for said golf bag to fit therein;

a baggy middle portion connected to said base portion for accommodating all storage sections of the golf bag, and having a first middle portion opening for allowing said golf bag to be inserted therein, with the base of said golf bag fitting into said base portion of said cover;

a top portion including means to at least partially removably connect it to an uppermost edge of a band forming an upper end of said middle portion, said top portion having sides, a bottom edge and an uppermost area, and having a height sufficient for covering said plurality of golf clubs stored in said golf bag, and further having first and second top portion openings, said first top portion opening for allowing access to said plurality of golf clubs, and second top portion opening positioned across the uppermost area of said top portion and extending along a side of said top portion, with said first and second top portion openings being transverse relative to one another; and said band having ends with means for securing said cover snugly in place around said neck of said golf bag, so as to position and maintain said cover in said place about said golf bag; whereby said protective cover may be retained on said golf bag even with the top portion partially removed or when completely removed may be collapsed and stored in said golf bag.

15. The cover according to claim 14 wherein said top portion connecting means includes said bottom edge of said top portion at least partially removably connected to said band by a zipper having at least one slider, so that said zipper and top and middle portions form a continuous structure.

16. The cover according to claim 15 further comprising a drawstring closure assembly substantially along the bottom edge of said top portion adjacent to said zipper.

17. The cover according to claim 14 wherein said top portion connecting means includes a series of cooperatively associated snap fasteners along the bottom edge of said top portion and said upper most edge of said band.

18. The cover according to claim 17 further comprising a drawstring closure assembly including a passage formed in said top portion adjacent said bottom edge, a drawstring in said passage, and at least one aperture through said top portion into said passage through which said drawstring passes.

19. The cover according to claim 14 wherein said top portion connecting means includes a cooperatively associated hook and loop fastener along the bottom edge of said top portion and said upper most edge of said band.

20. The cover according to claim 19 further comprising a drawstring closure assembly including a passage formed in said top portion adjacent said bottom edge, a drawstring in said passage, and at least one aperture through said top portion into said passage through which said drawstring passes.

21. The cover according to claim 14 further including straps generally between said middle and top portions to prevent said band and said middle portion of said protective cover from sliding down said golf bag when said top portion is completely removed.

22. The cover according to claim 21 wherein said straps are parallel to and juxtaposed to separating partition bars of said golf bag.

23. The cover according to claim 21, wherein said straps and said protective cover are all made of the same material.

24. A pliable and foldable protective cover for covering an entire golf bag having a plurality of storage sections, a neck and a base and being adapted to store a plurality of golf clubs comprising:

a base portion of a diameter and size for said golf bag to fit therein;

a baggy middle portion connected to said base portion for accommodating all storage sections of the golf bag, and having a first middle portion opening for allowing said golf bag to be inserted therein, with the base of said golf bag fitting into said base portion of said cover;

a top portion, including means for at least partially removing and, for being connected to an uppermost edge of said middle portion, said top portion having sides, a bottom edge and an uppermost area, and having a height sufficient for covering said plurality of golf clubs stored in said golf bag, and further having first and second top portion openings, said first top portion opening for allowing access to said plurality of golf clubs, and second top portion opening positioned across the uppermost area of said top portion and extending along a side of said top portion, with said first and second top portion openings being transverse relative to one another; and means forming a part of said cover disposed generally between said middle and top portions for securing in conjunction with said base portion said cover to said golf bag, so as to position and maintain said cover in said place about said golf bag; whereby said protective cover may be retained on said golf bag even with the top portion partially removed or when completely removed may be collapsed and stored in said golf bag.

25. The cover according to claim 24, wherein said top portion is completely removable.

26. The cover according to claim 24, wherein said at least partially removable top portion is connected along a portion of a band attached to said middle portion; thereby forming a hinge for said top portion.

27. The cover according to claim 26, wherein said hinge is integrally formed with said top portion and the band of said middle portion.

28. The cover according to claim 24 wherein said protective cover is made from a pliable water resistant material.

29. The cover according to claim 24, wherein said material is made of synthetic and natural rubbers.

30. The cover according to claim 24, wherein said protective cover is made from a waterproof material.

31. The cover according to claim 24, wherein said material is made of a polyethylene-cotton.

32. The cover according to claim 24, wherein said material is made of nylon.

33. The cover according to claim 24, wherein said material is made of dacron.

34. The cover according to claim 24, wherein said material is made of a rayon.

35. The cover according to claim 24, wherein said material is made of polyamides.

36. The cover according to claim 24, wherein said material is made of laminated fabrics.

37. The cover according to claim 24, wherein said material is made of layered fabrics.

38. The cover according to claim 24, wherein said material is made of Gortex.

39. The cover according to claim 24, wherein said material is made of a sailcloth.

* * * * *